United States Patent [19]

Biasuzzi et al.

[11] 4,300,307

[45] Nov. 17, 1981

[54] ANIMATED TOY

[76] Inventors: Patricia A. Biasuzzi, Pole #120, Cooper Rd., Harmony, R.I. 02829; George W. Ptaszek, P.O. Box 260, Pascoag, R.I. 02859

[21] Appl. No.: 169,739

[22] Filed: Jul. 17, 1980

[51] Int. Cl.[3] ..... A63H 3/14
[52] U.S. Cl. ..... 46/154; 46/126
[58] Field of Search ..... 46/154, 126, 151, 153, 46/156–158; D2/79

[56] References Cited

U.S. PATENT DOCUMENTS

| | | | |
|---|---|---|---|
| 2,754,121 | 7/1956 | Jupiter | 46/151 X |
| 3,382,504 | 5/1968 | Barbosa | 46/151 X |
| 3,942,283 | 3/1976 | Rushton | 46/158 X |

OTHER PUBLICATIONS

Puppet Doll, Washington Daily News, 3-31-1952.

*Primary Examiner*—Gene Mancene
*Assistant Examiner*—Mickey Yu
*Attorney, Agent, or Firm*—Barlow & Barlow

[57] ABSTRACT

An animated toy resembling a stuffed animal has a pair of arms with pockets therein into which the hands of the user may be inserted. The pocket is configured so as to provide for places for the fingers to be placed so that the user may pick up objects and the like. In addition, the toy is provided with leg appendages that extend from the body portion of the toy and on the bottom of the appendages is a band through which the manipulator's hands may extend, the band being preferably provided with a buttonlike device so that the toy makes a clicking sound when it is manipulated as if it were dancing. Also, buttons may be on the palms of the arms for similar sound generation when clapping.

4 Claims, 5 Drawing Figures

ANIMATED TOY

BACKGROUND OF THE INVENTION

Stuffed animals have always been a source of amusement to children and are generally constructed in such a way that they are cuddly. In general, animals of this type of configuration which are stuffed and considered cuddly, cannot be manipulated so as to simulate movement of an animal. In the prior art there are hand puppets, such as gloves which one may place on one's hands as seen in U.S. Pat. No. 2,852,885; U.S. Pat. No. 1,417,860; U.S. Pat. No. 2,729,024. An example of a full figured doll-like puppet is seen in U.S. Pat. No. 3,820,276.

SUMMARY OF THE INVENTION

An animated toy is disclosed which basically has a stuffed body with a head and then has a pair of arm-like unfilled appendages that are stitched to the upper portion of the body and may be made out of two layers of fabric, there being a slit part of the way down the appendage so as to form a pocket in the hand area of the toy into which the user's hand may be readily received. The pockets may have discs affixed thereto to create a sound when manipulated as in clapping. Extending from the bottom of the body portion are a pair of leg appendages that may also be stuffed with the same material as the body of the toy, and at the bottom of the appendages which resemble legs, pockets are provided so as to receive the hand of the user, the bottom of the pockets being provided with button-like members so that when the toy is manipulated as in dancing or hopping, there will be a sound generated.

It is therefore a general object of the instant invention to provide an improved stuffed toy which may be utilized not only as a stuffed toy but also as a puppet and one which resembles an animal that may be manipulated in such a way as to entertain as well as to be adored.

DESCRIPTION OF THE PREFERRED EMBODIMENT

Figure 1:
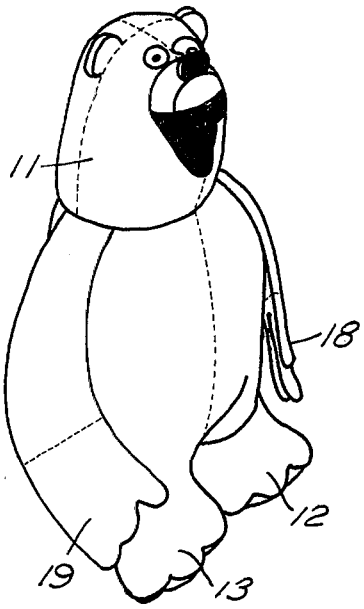
FIG. 1 is an oblique perspective view of an animated toy made in accordance with the instant invention.
Figure 2:
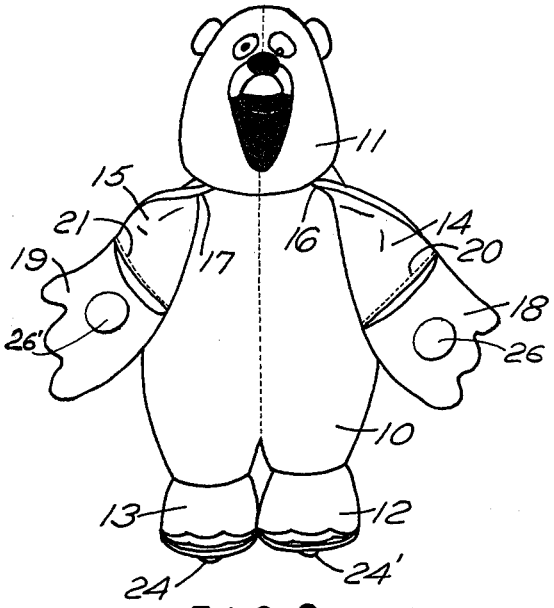
FIG. 2 is a front elevational view thereof.

Referring now to FIGS. 1 and 2, an animated toy in the form of a stuffed animal is illustrated and consists generally of a body section 10 having a head 11 and a pair of leg-like appendages 12 and 13. The body, the head and the leg appendages are filled with suitable material, such as a polyester filler, and as will be appreciated, the body, head and leg sections may be conveniently made from a number of panels of soft fluffy fabric, such as, for example, synthetic fur, a velour fabric, plush or the like, the various panels being delineated by the dotted lines on the drawing and may be, of course, formed in divers other ways, all well known to those skilled in the stuffed animal art.

Figure 3:
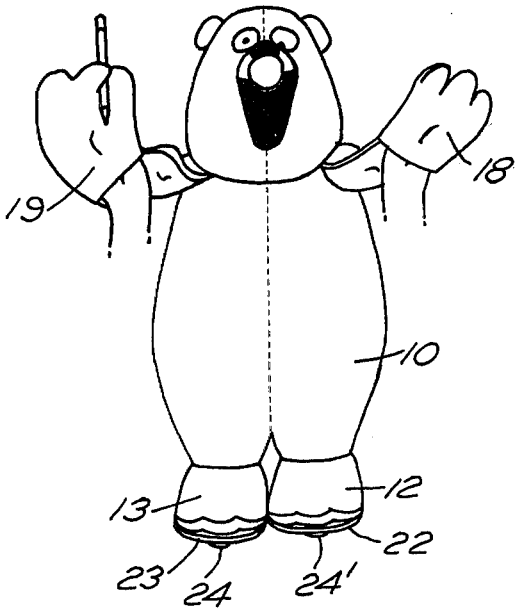
FIG. 3 is a similar view showing the toy in use with hands inserted into the arm pockets.

A pair of arms 14 and 15 are stitched to the upper portion of the body 10 as at 16 and 17 respectively, each of the arms being formed of two layers of fabric. At the terminus of each of the arm sections 14 and 15, pockets 18 and 19, respectively, are formed as by cutting one layer of the fabric and stitching the same as at 20 and 21, respectively to form a slit opening. By such an arrangement as can be seen by referring to FIG. 3, the user may readily place his hands within the pockets 18 and 19 and by virtue of the fact that the terminus of the pockets are formed with portions that simulate receptacles for one's fingers, articles such as the illustrated pencil may be readily grasped and held by the animal. The pockets 18 and 19 may also have discs 26, 26' affixed thereto. As the arms are manipulated as in clapping, these discs will create a sound that would not be present, if the fabric were brought together. It will also be apparent that while the openings for the pockets 18 and 19 are illustrated on one side face of the arms, the same arrangement may be constructed on the face shown full in FIG. 1 with identical results.

Figure 4:
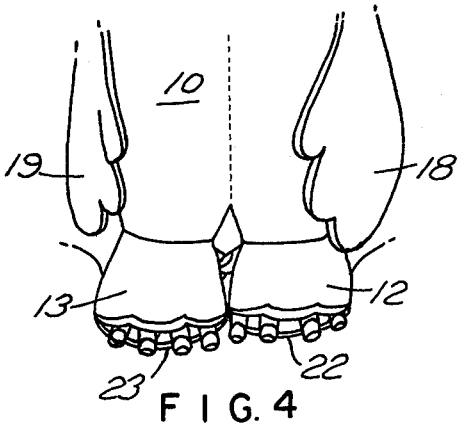
FIG. 4 is a partial view showing the lower portion of the animated toy with hands inserted into the pockets formed by bands at the terminus of the leg appendages.
Figure 5:
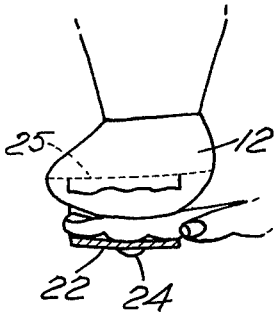
FIG. 5 is a partial side elevational view partly in section showing the pocket from the bottom of the leg-like appendages.

The lower appendages which simulate legs are designated 12 and 13 have strips of fabric 22 and 23 respectively extending across the bottom portion of the appendages and stitched to the appendages as at the stitch lines that are seen in FIG. 5 and designated 25. The strips or bands 22 and 23 effectively form loops that act as pockets between the bottom of the leg appendages so that a hand as seen in FIGS. 4 and 5 may be readily inserted. When a pair of hands are inserted into the pockets below the leg appendages, the stuffed body is sufficiently stiff so as to stand erect and the user may readily animate the toy by having it dance. In many cases it is desirable to have a sound accompanying the dance routine, and for this purpose buttons, such as 24, 24', may be affixed to the fabric pieces 22, 23 so that when the toy is used on a hard surface a click-click sound of a tap dancer will be simulated.

It will be of course apparent that the animated toy may assume a variety of configurations beyond the "Teddy Bear" form that is illustrated in the drawings, the illustrated embodiment being merely an example of the invention.

We claim:

1. An animated toy having a body member filled with a soft packing, a filled head extending from one end of the body member, a pair of unfilled arm-like appendages attached to the body portion to represent arms, a pair of filled leg-like appendages extending from the end of the body portion opposite the head, each of said arm-like appendages comprising flexible fabric and each having a pocket formed by two layers of fabric that encompasses a portion only of the appendage at the terminal end thereof the entrance to said pocket being located inwardly of said end and adapted to receive a user's hand that may be inserted therein, said leg appendages each having a loop at the terminus thereof to receive a hand of a user, said body, head and legs being filled with a solid material, sufficiently dense to be stiff enough to stand erect while the user's hand is manipulating the toy.

2. An animated toy as in claim 1 wherein the arm-like appendages comprise a double layer of fabric with a pocket at the terminus thereof.

3. An aminated toy as in claim 1 wherein the leg loop has a button-like member affixed thereto.

4. an animated toy as in claim 1 wherein the pocket portions of the arm-like appendages have disc members affixed thereto.

* * * * *